US005746357A

United States Patent [19]

Beveridge et al.

[11] Patent Number: 5,746,357

[45] Date of Patent: May 5, 1998

[54] PLUNGER AND APPARATUS USEFUL IN EXTRUDING OR DISPENSING VISCOUS MATERIALS

[75] Inventors: Keith A. Beveridge, Dayton; Mark A. Bennett, Mason; Kenneth R. Waeber, Loveland; Clinton A. Haynes, West Chester, all of Ohio

[73] Assignee: Essex Specialty Products, Inc., Auburn Hills, Mich.

[21] Appl. No.: 635,984

[22] Filed: Apr. 22, 1996

[51] Int. Cl.[6] ..... B67D 5/42

[52] U.S. Cl. ..... 222/386

[58] Field of Search ..... 222/327, 391, 222/386

[56] References Cited

U.S. PATENT DOCUMENTS

| | | | |
|---|---|---|---|
| 2,809,774 | 10/1957 | Kaye et al. | 222/263 |
| 4,083,477 | 4/1978 | Zetterberg | 222/386 |
| 4,169,547 | 10/1979 | Newell | 222/386 |
| 4,311,258 | 1/1982 | Bradshaw | 222/391 |
| 4,645,098 | 2/1987 | Hoffmann | 222/386 |
| 4,715,518 | 12/1987 | Moore | 222/257 |
| 4,854,485 | 8/1989 | Collins | 222/386 |
| 4,874,115 | 10/1989 | Weihrauch | 222/386 |
| 4,890,773 | 1/1990 | Corsette | 222/380 |
| 4,907,727 | 3/1990 | Ernst et al. | 222/386.5 |
| 4,964,541 | 10/1990 | Gueret | 222/137 |
| 5,092,496 | 3/1992 | Gayle et al. | 222/386 |
| 5,547,107 | 8/1996 | Boiardi | 222/327 |

FOREIGN PATENT DOCUMENTS

| | | | |
|---|---|---|---|
| 650964 | 10/1962 | Canada | 222/386 |
| 468627 | 7/1914 | France . | |
| 1057415 | 3/1954 | France . | |
| 596995 | 8/1959 | Italy . | |

*Primary Examiner*—Philippe Derakshani
*Attorney, Agent, or Firm*—Norman L. Sims

[57] ABSTRACT

The invention is a plunger useful in extruding or dispensing viscous material which comprises a thin disc of a material which is capable of deforming when subjected to back pressure during use. The edge of the disc has a circular shape and a cylindrical lip attached to the edge of the disc, which lip is disposed perpendicular to the edge of the disc. The disc has a face and a back surface located on opposite sides of the sheet. The disc also has a symmetrical convex portion which protrudes beyond the plane defined by the edge of the disc in the direction of the face and the peak of the convex portion disposed in the center of the disc. The disc further comprises a symmetrical concave portion which protrudes beyond the plane defined by the edge of the disc in the direction of the back surface. The concave portion of the disc surrounds the convex portion of the disc and the convex portion starts at the bottom of the concave portion. The radius of the convex portion, measured from the peak to the bottom of the concave portion, is sufficient to withstand the back pressure exerted during use without inverting. The slope of the wall of the concave portion from the edge to the bottom of the concave portion is disposed such that, when back pressure is exerted on the plunger, the edge deforms radially outward.

9 Claims, 2 Drawing Sheets

PLUNGER AND APPARATUS USEFUL IN EXTRUDING OR DISPENSING VISCOUS MATERIALS

BACKGROUND OF THE INVENTION

The invention relates to a plunger, and dispensing device incorporating the plunger, useful in dispensing viscous materials, for instance, adhesive materials.

Dispensing devices for dispensing or extruding viscous material generally comprise a cylindrical container having a nozzle or port which has a cross-sectional area which is significantly less then the cross-sectional area of the cylindrical container. The material to be dispensed is placed in the container and a plunger or piston is placed on the opposite end of the material to be dispensed from the port or nozzle. Pressure is applied by means of the plunger piston to the viscous material, thereby forcing a portion of the viscous material out of the nozzle or port and allowing its application in an appropriate manner.

It is generally well known that considerable force is required, depending upon the viscosity of the fluids to be dispensed, for dispensing or extruding the fluids out of the container. Accordingly, high pressure is exerted upon the pistons or plungers and also upon the container walls. Due to this pressure acting upon the container walls, the container walls tend to expand radially so that a certain amount of radial play develops between the piston or plungers and the container. This radial play tends to cause a loss of sufficient sealing and thus a portion of the fluids being dispensed can escape out of the rear end of the container. Additionally, if sufficient loss of sealing occurs, the ability to extrude or dispense the viscous material out the port nozzle may be lost.

U.S. Pat. No. 4,907,727, discloses a device having improved plunger assemblies. Disclosed is a dispensing device and plunger designed to prevent this loss of sealing. The plunger assembly uses a plastic end-cap which can deform when pressure is applied. Internal to the end-cap is a piston having on its head, a rubber pad which fits inside of the end-cap. This rubber disc reacts to applied forces by expanding radially to tighten the seal of the end-cap so as to prevent leaking through the rear. The rubber disc and the end-cap form an air chamber which resists deformation. This is a complex solution which is costly to the user.

Many commercial systems are unable to extrude highly viscous materials and fail when back pressure of the viscous material of somewhere between 50 and 100 psi is reached. Therefore, what is also needed is a plunger and apparatus for dispensing viscous materials incorporating such a plunger which can dispense materials under conditions such that the back pressure is greater than about 50 to 100 psi.

What is needed is a relatively inexpensive plunger and apparatus incorporating the plunger for dispensing viscous materials which, during normal operation, prevents backward loss of material through breaking of the seal. Further, what is needed is a plunger which meets such objectives while working in commercially available dispenser systems.

SUMMARY OF THE INVENTION

The invention is a plunger useful in extruding or dispensing viscous material, which comprises a thin disc of a material which is capable of deforming when subjected to back pressure during use. The edge of the disc has a circular shape and a cylindrical lip attached to the edge of the disc, which lip is disposed perpendicular to the edge of the disc.

The disc has a face and a back surface located on opposite sides of the sheet. This also has a symmetrical convex portion which protrudes beyond the plane defined by the edge of the disc in the direction of the face and a peak of the convex portion disposed in the center of the disc. This further comprises a symmetrical concave portion which protrudes beyond the plane defined by the edge of the disc in the direction of the back surface. The concave portion of the disc surrounds the convex portion of the disc and the convex portion starts at the bottom of the concave portion. The radius of the convex portion measured from the peak to the bottom of the concave portion is sufficient to withstand the back pressure exerted during use without inverting. The slope of the wall of the concave portion from the edge to the bottom of the concave portion is disposed such that, when back pressure is exerted on the plunger, the edge deforms radially outward.

In another embodiment, the invention is a plunger, as described above, fabricated from a rigid, deformable plastic.

The plunger disclosed herein is capable of working in any commercially available system while allowing the extrusion of viscous material without the loss through the back of the cylindrical container in which the material is extruded. In addition, the plunger is incorporated into an apparatus which meets the object of the invention. Further, the plunger allows extrusion of materials under conditions which create back pressure of up to 450 psi.

DETAILED DESCRIPTION OF THE INVENTION

Figure 1:
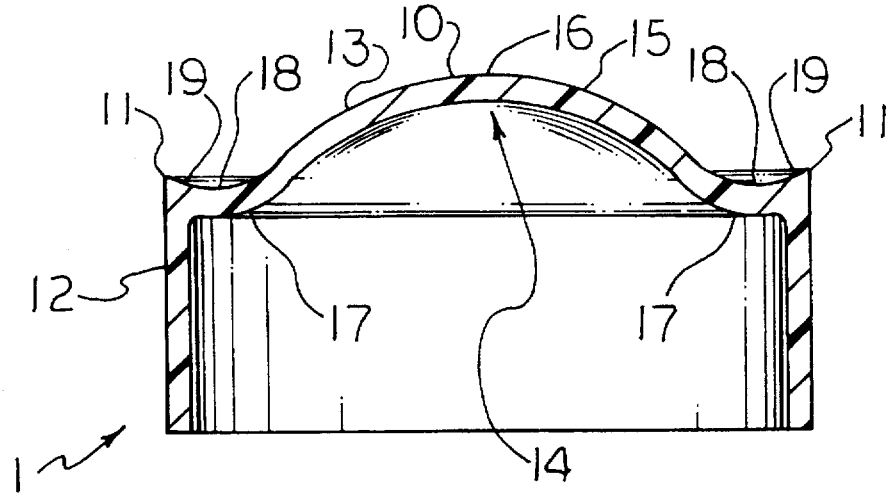
FIG. 1 is a side view of the plunger of the invention.

FIG. 1 is a cut-away view of a plunger (1) according to the invention wherein the cut is taken through the center of the plunger and the view is from the side. FIG. 1 demonstrates a plunger (1) comprising a circular shaped disc (10) having an edge (11) located around the periphery of the disc. The plunger (1) is a thin sheet of a material in the shape of a cylindrical disc (10). Protruding from the edge of the disc (11) and disposed perpendicular to the edge of the disc (11) is a cylindrical lip (12). The cylindrical lip (12) is adapted to stabilize the plunger (1) during use in a circular dispensing apparatus (not shown in FIG. 1). The disc (10) has a face (13) and a backside (14). The face (13) of the symmetrical disc (10) has a symmetrical convex portion (15). The peak (16) of the symmetrical convex portion (15), protrudes beyond the plane defined by the edge (11) of the disc in the direction of the face (13), and is disposed at the center of the disc. The disc (10) further has a symmetrical concave portion (17) which protrudes beyond the plane defined by the edge (11) of the disc (10) in the direction of the back surface (14) wherein the concave portion (17) surrounds the convex portion (15). The convex portion (15) starts at the bottom (18) of the concave portion (17) of the disc (10). The radius of the concave portion (15) is measured from the peak (16) to the bottom (18) of the concave portion (17). Such radius is sufficient to withstand the back pressure exerted on the disc without inverting the concave portion (17). The slope (19) of the concave portion (17) of the disc (10) from the edge (11) of the disc (10) to the bottom (18) of the concave portion (17) of the disc (10) is selected such that, when back pressure is applied to the face (15) of the disc (10), the edge (11) of the disc (10) expands radially outward and forms a seal between the edge (11) of the disc (10) and the inside wall of a dispenser (not shown).

Figure 2:
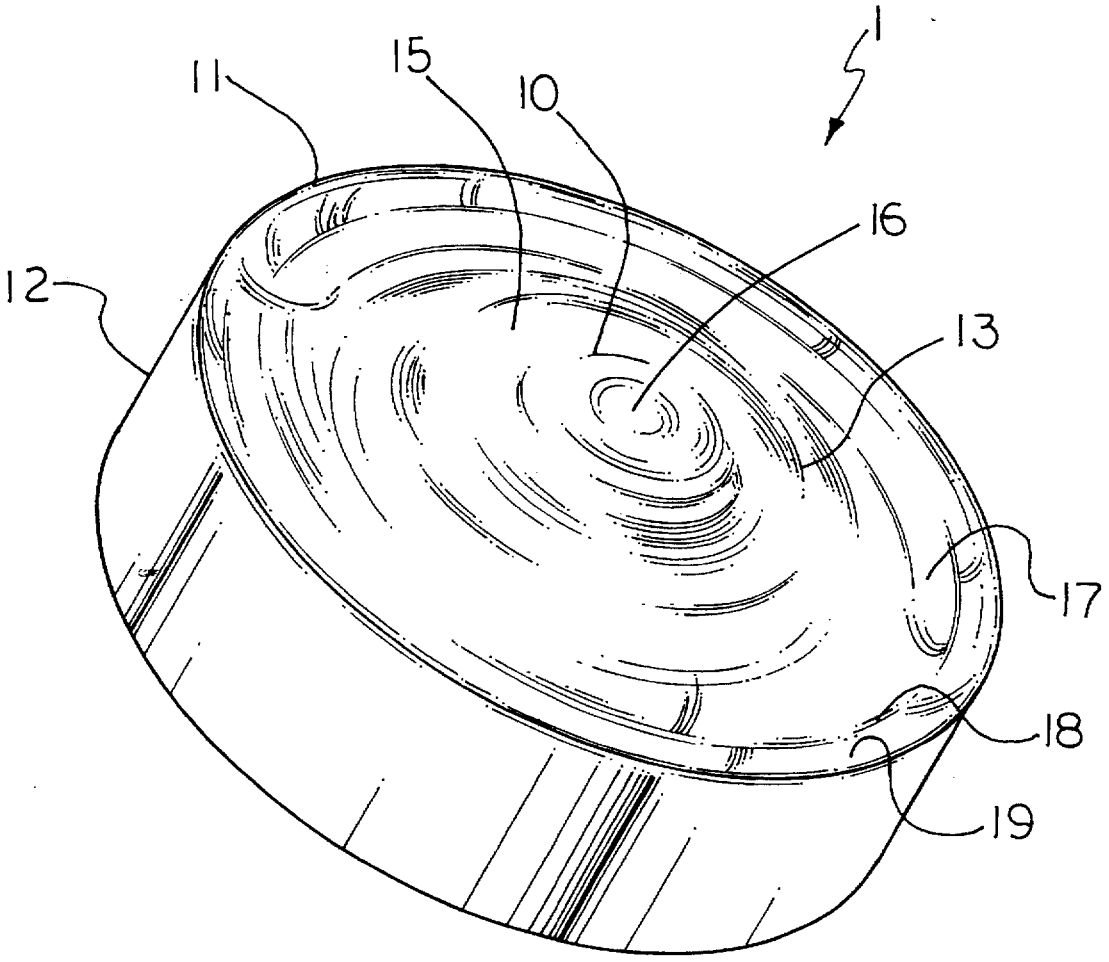
FIG. 2 is an off-set view of the plunger illustrating the circular face and the lip of the plunger.

FIG. 2 is an off-set view of the plunger of the invention showing the entire face and a portion of the lip of the invention.

FIG. 2 demonstrates the plunger (1), a face (13) and its edge (11) located around the periphery of a circular shaped disc (10). Also shown is the cylindrical lip (12) protruding from the edge of the disc (10) and disposed perpendicular to the edge of the disc (11). The symmetrical convex portion (15) of the face (13) of the symmetrical disc (10) is shown. The peak (16) of the symmetrical convex portion (15) protrudes beyond the plane defined by the edge (11) of the disc in the direction of the face (13) and is disposed at the center of the disc (10). The symmetrical concave portion (17) which surrounds the convex portion (15) and has a bottom (18) is shown. The slope (19) of the concave portion (17) of the disc (10) from the edge (11) of the disc (10) to the bottom (18) of the concave portion (17) of the disc (10) is shown.

Figure 3:
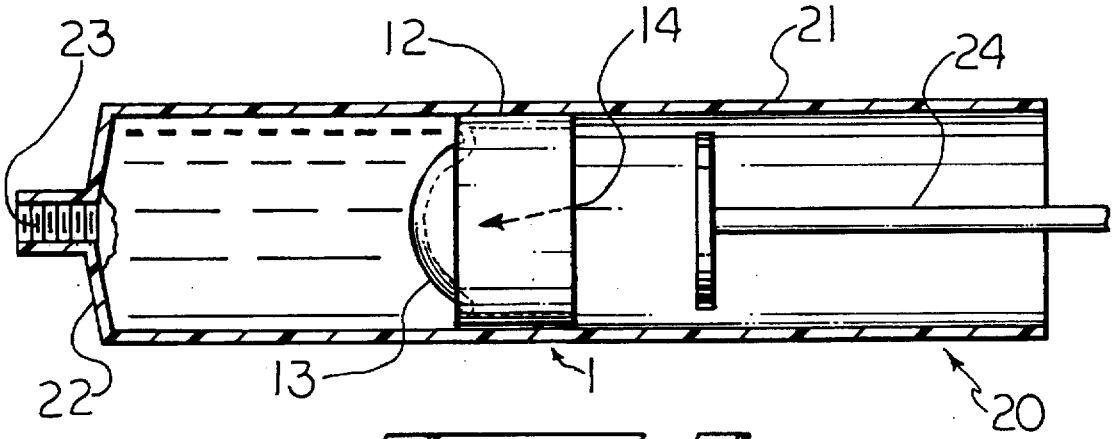
FIG. 3 is an illustration of the plunger in a dispensing apparatus.

FIG. 3 is a dispenser (20) which contains a plunger (1) as described hereinbefore. The dispenser comprises a circular cylinder (21) which is adapted for holding materials which exhibit fluid characteristics under pressure. The plunger (1) is disposed in the dispenser (20) such that the lip (12) lies adjacent to the wall of a circular dispenser (20) and the plane defined by the edge of the plunger (11) is perpendicular to the direction of the cylinder (21). At one end of the circular cylinder (21) is an end-piece (22) which has a port (23) adapted for removal of the materials from the end of the cylinder (21). The port (23) has a cross-sectional area less than that of the cylinder (21). The face (13) of the plunger is directed toward the closed end (22) having a port (23) in it. The plunger further contains a piston or mechanical ram (24) adapted to push the plunger (10) in the direction of the end-piece (22) having the port (23). As the piston (24) pushes the plunger (10) in the direction of the end piece (22) having a port (23) therein, material contained in the circular cylinder (21) is forced through the port (23) so that it may be dispensed as desired.

The plunger may be made of any material which has an elastic modulus such that the material will deform when exposed to significant back pressure but is also capable of pushing the material to be extruded from the dispensing apparatus through the port in the end-piece. Preferably, the material that the plunger is made from has a modulus of 75,000 psi or greater, and more preferably 100,000 psi or greater. Preferably, the material from which the plunger is prepared has a modulus of 600,000 psi or less and more preferably 500,000 psi or less. Additionally, the material from which the plunger is made must be such that it has the strength to withstand the back pressure exerted by the material contained in the cylinder during extrusion of the material out the port. Preferably, the material withstands a back pressure of 50 psi or greater, more preferably 100 psi or greater, and most preferably 150 psi or greater. Preferably, the material from which the plunger is prepared withstands a back pressure of 400 psi or less and more preferably 250 psi or less. The plunger is preferably prepared from a rigid thermoplastic material. More preferably, the rigid thermoplastic material is a polyolefin, vinylidene aromatic polymer, a monovinylidene aromatic monomer-conjugated diene block copolymer, or polyvinylchloride. Most preferably, the plunger is polystyrene, polyethylene, polypropylene, polyvinylchloride, or a styrene-butadiene-styrene block copolymer. Even more preferably, the plunger is made from polyethylene. The thickness of the plunger should be sufficient to withstand the back pressures described hereinbefore. Preferably, the plunger has a thickness of 0.50 mm or greater, more preferably 1.25 mm or greater and most preferably 1.75 mm or greater. Preferably, the plunger has a thickness of 7.50 mm or less, more preferably 5.00 mm or less and most preferably 3.00 mm or less. The plunger preferably has a diameter, as measured along the face from edge to edge at its thickest point, which is slightly less than the inside diameter of the dispenser. The diameter should be such that the plunger can be inserted into the cylinder yet large enough such that when the plunger is subjected to back pressure, it deforms radially to form a seal between the edge of the plunger and the circular cylinder. It is advantageous that there be a small air gap between the edge of the plunger and the cylinder wall to allow air to flow past the plunger as it is inserted into or removed from the dispensing apparatus. Preferably, the diameter of the plunger is 12.5 mm or greater, more preferably 25 mm or greater and most preferably 38 mm or greater. Preferably, the diameter of the plunger is 127 mm or less more preferably 100 mm or less and most preferably 75 mm or less. The lip of the plunger in use is adjacent to the wall of the cylinder and is long enough to provide stability to the plunger and to prevent misalignment. The lip should be long enough to prevent cocking and binding of the plunger during use when back pressure is applied to the face of the plunger. Preferably the lip has a length of 5 mm or greater, and more preferably 15 mm or greater. Preferably, the lip has a length of 50 mm or less and more preferably 40 mm or less.

The convex portion of the face protrudes in the face direction from the plane defined by the edge of the disc. The distance that it protrudes from such plane is dependent upon the diameter of the disc and the back pressure which the plunger is designed to withstand. Preferably, the distance ratio of protrusion to the diameter from the edge plane of the edge of the disc to the peak of the convex portion is 0.1 or greater, more preferably 0.13 or greater, and is preferably 0.4 or less and more preferably 0.25 or less. The radius of the convex portion of the disc, as measured from the peak to the bottom of the concave portion of the disc, is sufficient such that when the plunger is exposed to back pressure as described herein, the convex portion does not invert.

The concave portion of the disc is symmetrical and surrounds the convex portion. The concave portion protrudes in the direction of the back surface and the bottom of the convex portion provides an edge on the back surface of the disc such that the means for applying pressure such as a piston can rest against the plunger and thereby force the plunger forward toward the end-piece on the cylinder which houses the plunger. The convex portion starts at the bottom of the concave portion.

The slope of the wall of the concave portion, from the edge of the disc to the bottom of the concave portion, should be such that when back pressure is applied to the plunger, the plunger deforms radially and such deformation forms a seal between the edge of the plunger and the cylinder wall such that the material to be dispensed or extruded does not leak behind the plunger. Preferably, the slope of the outer wall of the concave portion is at an angle of 10 degrees or greater, more preferably 20 degrees or greater, even more preferably 25 degrees or greater and most preferably 40 degrees or greater.

Preferably, the slope of the outer wall of the concave portion is at an angle of 90 degrees or less, more preferably 80 degrees or less, even more preferably 70 degrees or less and most preferably 50 degrees or less. The angle is measured from the plane defined by the edge of the plunger.

The plunger of the invention can be used in any conventional apparatus which is useful in extruding or dispensing viscous materials. A preferred apparatus is illustrated in FIG. 3. The plunger can be used in any commercially available apparatus. The cylinder itself can be plastic, metal or cardboard. The cylinder has one end closed with a port in it designed for extruding or dispensing material. The port has a cross-section which is less than the cross-section of the cylinder. This port can be a hole or a nozzle or any other means for allowing material to escape from the cylinder when exposed to pressure. The apparatus further contains a means for exerting pressure on the back surface of the plunger. This means should exert sufficient pressure to extrude the material contained in the cylinder through the port. The means for exerting pressure can be any means for exerting pressure well known to those skilled in the art of dispensing apparatus wherein this dispensing apparatus is designed to extrude or dispense viscous materials. The pressure applied to the back surface of the plunger may be applied by mechanical means such as a piston, driven by electrical means, hydraulic means or by the application of air. The piston can rest on the backside of the concave portion. Alternatively, pressure can be placed on the backside of the pistons by use of high pressure air or hydraulic pressure. In this embodiment, care should be taken such that the seal between the edge or lip of the plunger is not broken. The apparatus of the invention is useful for extruding material which is fluid under pressure. Such materials are, for example, toothpaste, adhesive, foodstuff, etc. Preferred materials are adhesives. Even more preferred are adhesives useful in bonding glass, such as automobile windows, into structures, such as automobiles. Preferably, the material has a viscosity of about 50,000 centipoise or greater and more preferably about 100,000 centipoise or greater. Preferably, the material dispensed or extruded by the apparatus under the invention has a viscosity of about 2,000,000 centipoise or less and more preferably 1,000,000 centipoise or less.

The material can be extruded onto a variety of surfaces to be bonded together, such as glass, metal or wood or plastic.

What is claimed is:

1. A plunger useful in extruding or dispensing viscous materials which comprises a thin, circular, disc-shaped sheet of a rigid thermoplastic material which is capable of deforming when subjected to back pressure during use, the edge of the disc having a circular shape and a cylindrical lip attached to the edge of the disc and disposed perpendicular to the edge of the disc, wherein the disc comprises:

A) a face and a back surface located on opposite sides of the disc,

B) a symmetrical convex portion which protrudes beyond the plane defined by the edge of the disc in the direction of the face wherein the peak of the convex portion is disposed in the center of the disc, and C) a symmetrical concave portion which protrudes beyond the plane defined by the edge of the disc in the direction of the back surface, wherein the concave portion surrounds the convex portion and the convex portion starts at the bottom of the concave portion of the disc, wherein the radius of the convex portion, measured from the peak to the bottom of the concave portion, is sufficient to withstand the back pressure exerted during use without inverting, and the slope of the wall of the concave portion from the edge to the bottom is disposed such that when back pressure is exerted on the plunger, the edge deforms radially outward.

2. A plunger according to claim 1 wherein the plastic exhibits a modulus of from about 75,000 to about 600,000 psi.

3. A plunger according to claim 2 which is fabricated from polyethylene, polypropylene, polyvinyl-chloride, polystyrene, a styrene-conjugated diene block copolymer or blends thereof.

4. A plunger according to claim 3 wherein the thickness of the disc is from about 0.50 mm to about 7.50 mm.

5. A plunger according to claim 4 wherein the concave portion can withstand a back pressure of from about 50 psi to about 400 psi.

6. A plunger according to claim 5 wherein the disc has a diameter of from about 12.5 mm to about 127 mm.

7. A plunger according to claim 6, wherein the slope of the wall of the concave portion from the edge of the disc to the bottom of the concave portion of the disc is at least about 10 degrees.

8. An apparatus for dispensing materials which exhibit fluid characteristics under pressure which apparatus comprises:

A) a circular cylinder adapted for holding materials which exhibit fluid characteristics under pressure;

B) an end piece at one end of the cylinder having a port adapted for removal of the materials from the end of the cylinder, the port having a cross-sectional area less than that of the cylinder;

C) disposed in the cylinder is the plunger according to claim 1 wherein the diameter of the plunger is slightly less than the diameter of the cylinder, the plane defined by the edge of the plunger is perpendicular to the direction of the cylinder and the lip on the plunger lies adjacent to the wall of the cylinder and protrudes in the direction opposite the closed end of the cylinder and the convex portion of the plunger protrudes in the direction toward the closed end of the cylinder; and D) a means for exerting pressure on the plunger from the side opposite of the closed end of the cylinder having a port wherein the pressure is sufficient to force material contained in the cylinder out through the port.

9. The apparatus of claim 8 wherein the means for exerting pressure is an electrically, hydraulically or mechanically driven piston.

* * * * *